United States Patent [19]

Troy et al.

[11] 3,966,858

[45] June 29, 1976

[54] LINEAR APPARATUS AND METHOD FOR HIGH SPEED PRODUCTION OF AIR-LAID NON-WOVEN WEBS

[75] Inventors: Marion Frank Troy, Hinsdale; Ewald Albert Kamp, Chicago, both of Ill.

[73] Assignee: Union Carbide Corporation, New York, N.Y.

[22] Filed: Jan. 25, 1974

[21] Appl. No.: 436,615

[52] U.S. Cl. ..... 264/91; 19/156.3; 156/62.2; 264/114; 264/121; 264/122; 264/128

[51] Int. Cl.[2] ..... B29J 5/00; D04H 1/58; D04H 1/60

[58] Field of Search ..... 264/121, 114, 91, 122, 264/128; 425/80, 83; 19/155, 156, 156.3, 156 A; 156/62.2; 28/72.3, 72 NW

[56] References Cited

UNITED STATES PATENTS

| | | | |
|---|---|---|---|
| 2,450,916 | 10/1948 | Coss et al. | 425/80 |
| 2,489,079 | 11/1949 | Clark et al. | 425/83 |
| 3,086,253 | 4/1963 | Joa | 264/121 |
| 3,308,218 | 3/1967 | Wiegand et al. | 264/121 |
| 3,356,780 | 12/1967 | Cole | 264/121 |
| 3,577,312 | 5/1971 | Videen et al. | 264/121 |
| 3,615,962 | 10/1971 | Kaspar | 425/83 |
| 3,781,150 | 12/1973 | Matsumara et al. | 425/80 |
| 3,882,211 | 5/1975 | Kamp | 264/91 |

*Primary Examiner*—W. E. Hoag
*Attorney, Agent, or Firm*—J. Hart Evans

[57] ABSTRACT

A non-woven fibrous web is continuously air-laid by directing a fluid stream of fibers from a rotating spinner against the inner surface of a moving foraminous belt which travels in an arc substantially around the circumference of the spinner, with suction being applied to the outer surface of the foraminous belt to facilitate uniform fiber lay-down and to remove the fluid.

16 Claims, 15 Drawing Figures

FIG. 1
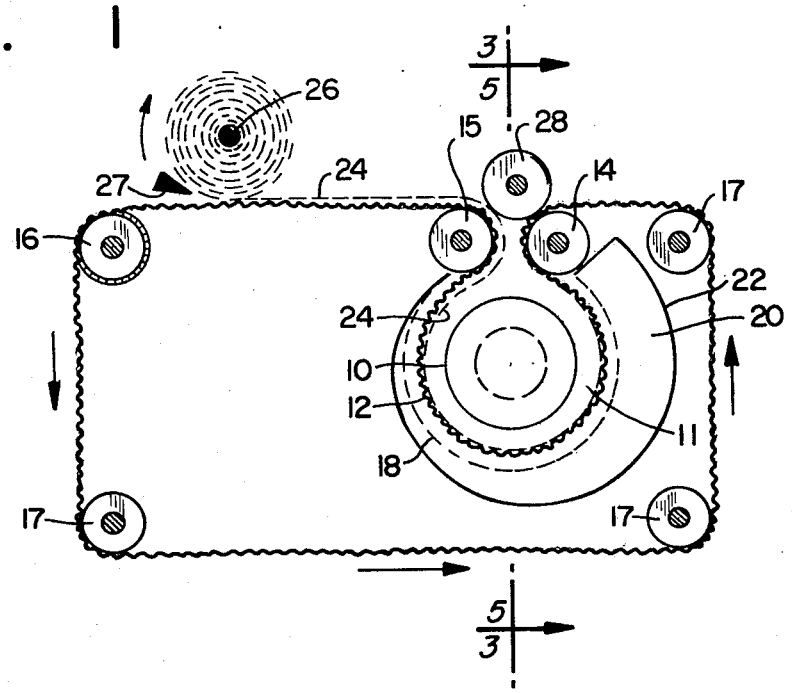
FIG. 2
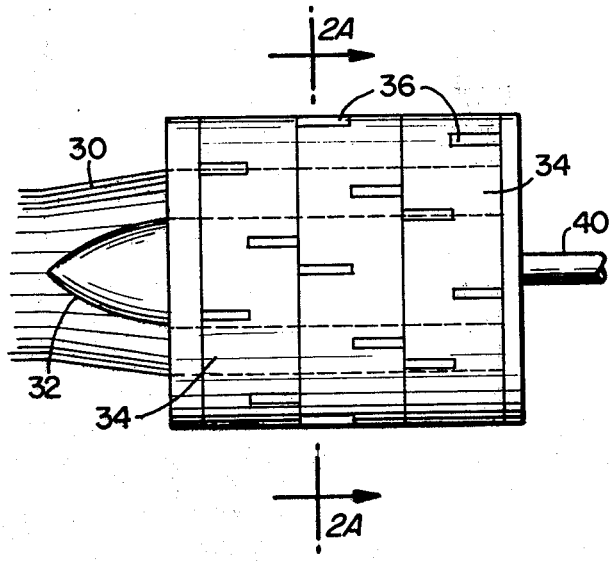
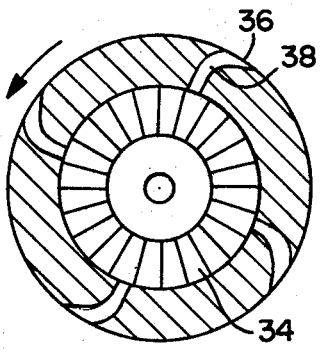
FIG. 2A

LINEAR APPARATUS AND METHOD FOR HIGH SPEED PRODUCTION OF AIR-LAID NON-WOVEN WEBS

This invention relates generally to the manufacture of non-woven webs and more particularly to the manufacture of such webs by a substantially dry air-lay procedure.

Apparatus and methods heretofore developed for such purposes have been limited in one or more important aspects such as speed, uniformity of deposits and type and length of fiber which can be handled.

Therefore it is an object of the present invention to provide a high speed machine capable of making a non-woven web of uniform thickness.

A further object of the invention is to provide a machine which will make such a web by a substantially dry process.

Yet another object is to provide a dry process method for the high-speed production of a non-woven web of uniform thickness.

Other objects of the invention will be apparent from the descriptions of the invention which follows.

The invention can be better understood by reference to the drawings:

FIG. 1 is an over-all schematic view of an apparatus according to the invention.

FIG. 2 is a side elevation of a fiber spinner according to the invention.

FIG. 2A is a cross-sectional view along the line 2A — 2A of FIG. 2.

Figure 3:
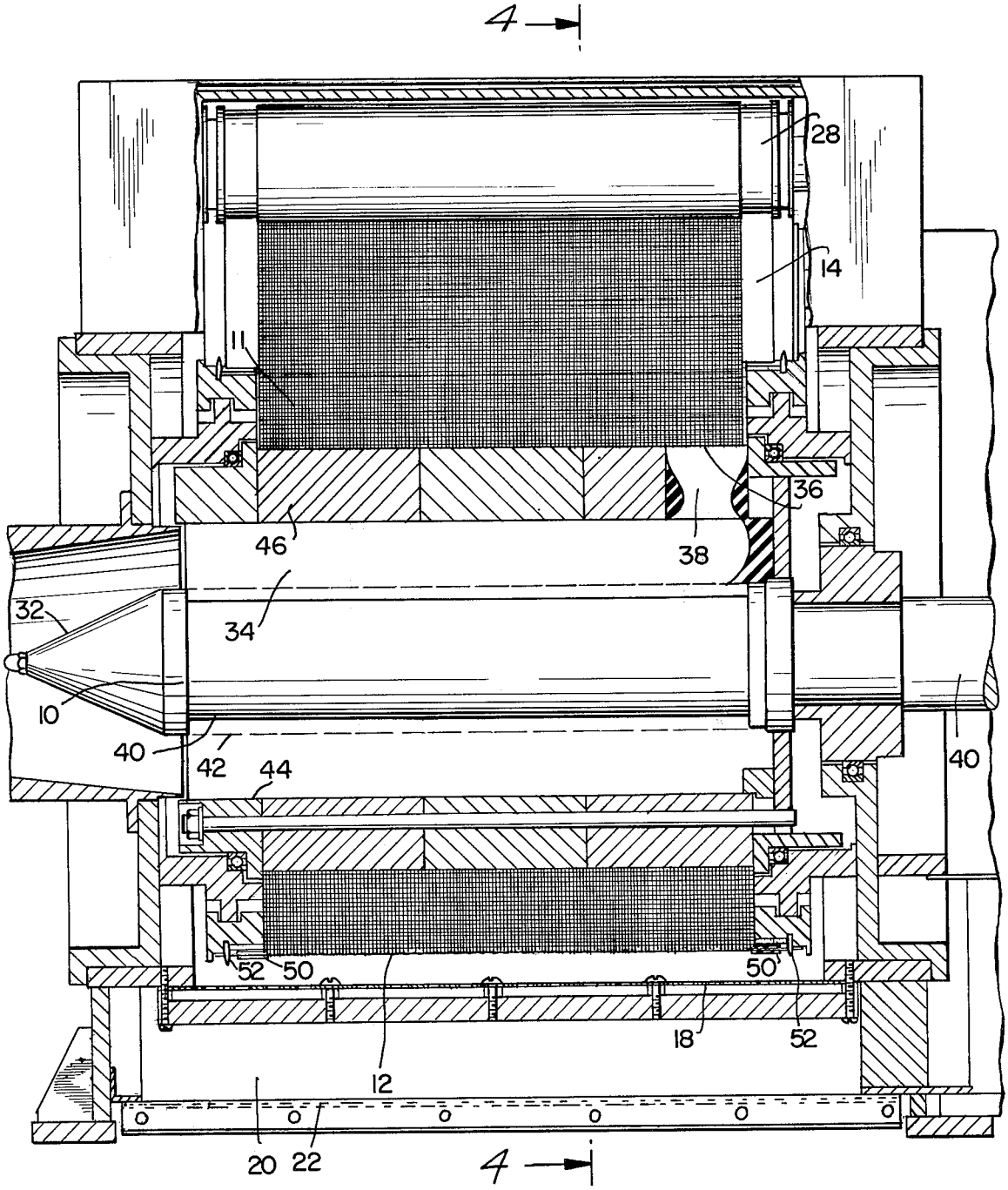
FIG. 3 is a cross-sectional view along the line 3/5 — 3/5 of FIG. 1 showing a single-ended spinner.

The present invention involves introducing a fiber laden stream of air into a rotating member or spinner which continuously rotates the stream and directs it through arcuate channels which function as directional flow nozzles to discharge the fibers in a centrifugal flow against a loop of moving foraminous belt which substantially envelopes the spinner in an arc around the axis of rotation of the spinner, with a suction plenum on the other side of the foraminous belt which exhausts the air from which the fibers have been extracted by the screen. Operation of the apparatus according to the invention results in the uniform deposit of fibers on the belt, with the thickness of the deposit increasing as the foraminous belt moves around the rotating spinner.

Referring to FIG. 1, the apparatus of the invention can be seen to comprise broadly a spinner 10 surrounded in an arc by a moving foraminous screen or belt 12 which runs around the deposit area 11 surrounding the spinner 10 and out of the enveloping arc over control roller 14 and then away from the deposit area 11 over control roller 15. The belt is pulled by drive roller 16 which is powered by a conventional motor, not shown. A perforate suction control plate 18 defines the inner surface of a plenum 20 formed by the plate 18 and an outer cover 22. The fibers leaving the spinner 10 collect on the belt 12 as a fibrous mat or web 24. After the belt 12 leaves the deposit area the fibrous web is removed to a take up roll 26. Fiber removal means 27, such as an air knife, may assist in separating the web from the belt. The belt 12 is then returned to the deposit area over return rollers 17. A sealing roller 28 maintains the deposit area pressure.

In FIGS. 2 and 2A a single ended spinner can be seen in more detail. The fiber laden air stream 30 is directed by the cone 32 into an annular stream which enters the various conduits 34 to emerge through openings 36 which terminate arcuate channels 38 connected to said conduits. The spinner 10 rotates on a shaft 40, which is supported by a conventional bearing and drives by a conventional motor, not shown.

In FIG. 3 an apparatus according to the invention with single ended spinner is shown in detail. A rotating shaft 40 powered by a motor not shown, supports an annular sleeve 42 in which are imbedded vanes 44 which define conduits 34. These conduits 34 connect to arcuate channels 38 which are formed in annular blocks 46. These channels 38 lead to openings 36. The fiber laden air stream entering the spinner through intake port 48 is deflected uniformly by the cone 32 into the multiple conduits 34. From the openings 36 the fiber laden air stream is directed in a centrifugal flow toward the foraminous screen or belt 12. A rim type sprocket 51, with shaped pins 52 at spaced intervals around the rim to serve as sprocket teeth, rides with relative low friction on an inner bearing 53. A reinforcing strip 50 attached to the edges of the screen 12 has paced perforations which are engaged by sprocket pins 52 whereby the screen 12 is kept taut across the width of the belt in a uniform profile while being transported around the perimeter of the spinner 10. These are the same perforations which are engaged by sprocket teeth on the ends of the drive roller 16 in FIG. 1. Fibers are pulled against the moving foraminous belt or screen 12 by the lowered pressure induced in the plenum 20 formed by the perforate suction control plate 18 and the outer cover 22. A sealing roller 28 assists in maintaining constant pressure in the deposit area 11.

Figure 4:
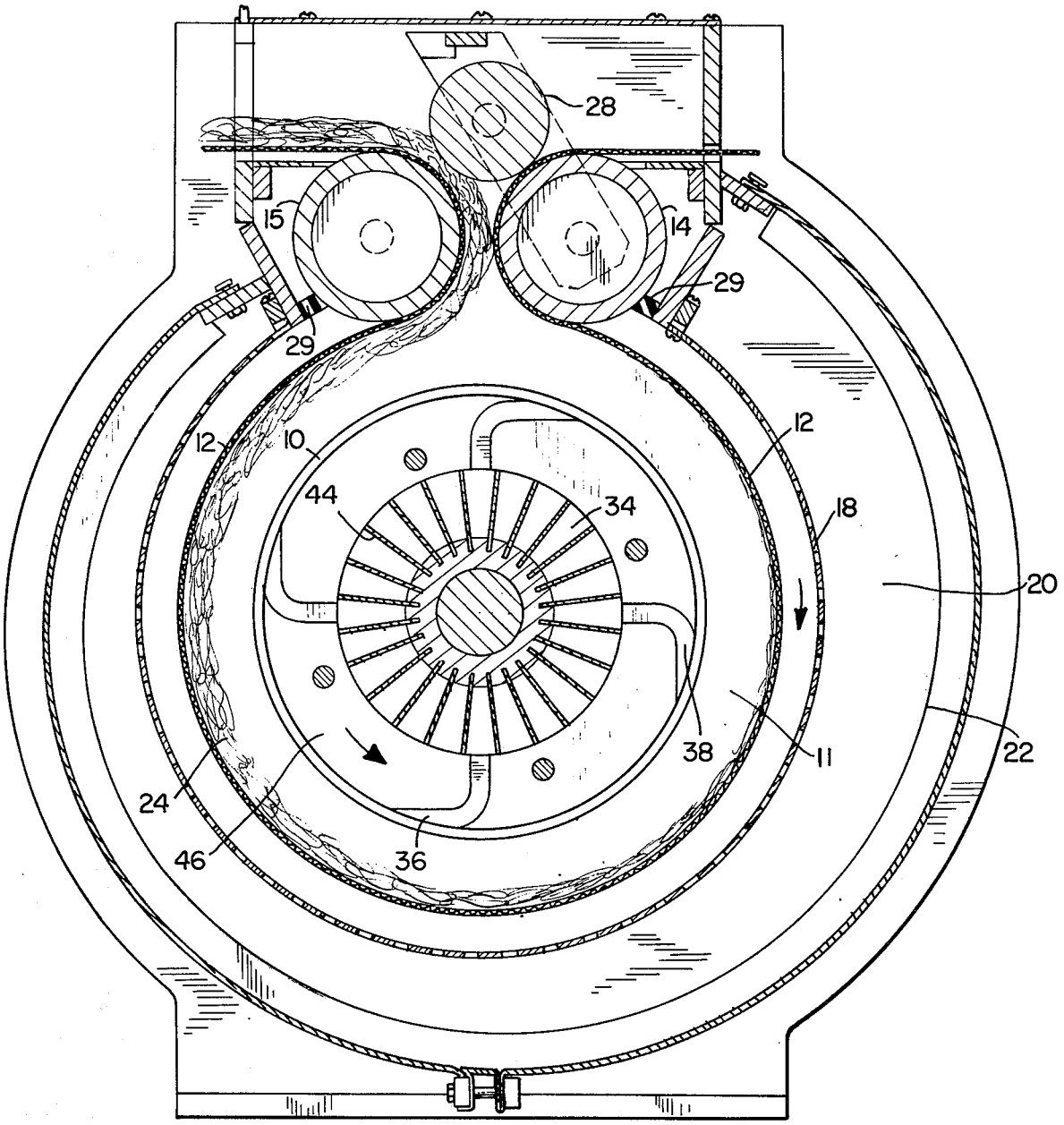
FIG. 4 is a cross-sectional view along the line 4—4 of FIG. 3 of a preferred embodiment of the invention.

A cross-sectional view in FIG. 4 serves to clarify the relationship of the components described with respect to the single ended spinner 10 of FIG. 3. A cross-sectional view of the double ended spinner **10*a* of FIG. 5 would be similar in all critical aspects but would vary in the construction of the hub of the spinner 10*a*, there being no central shaft coming in from one end in the double ended nozzle. In FIG. 4 the progressive build-up of the fibrous mat or web 24 can be seen as the foraminous screen or belt 12 moves in an arc path around the outside of the spinner 10. Also shown in FIG. 4 are seals 29 which further assist in maintaining pressure in the deposit area 11.**

Figure 4A:
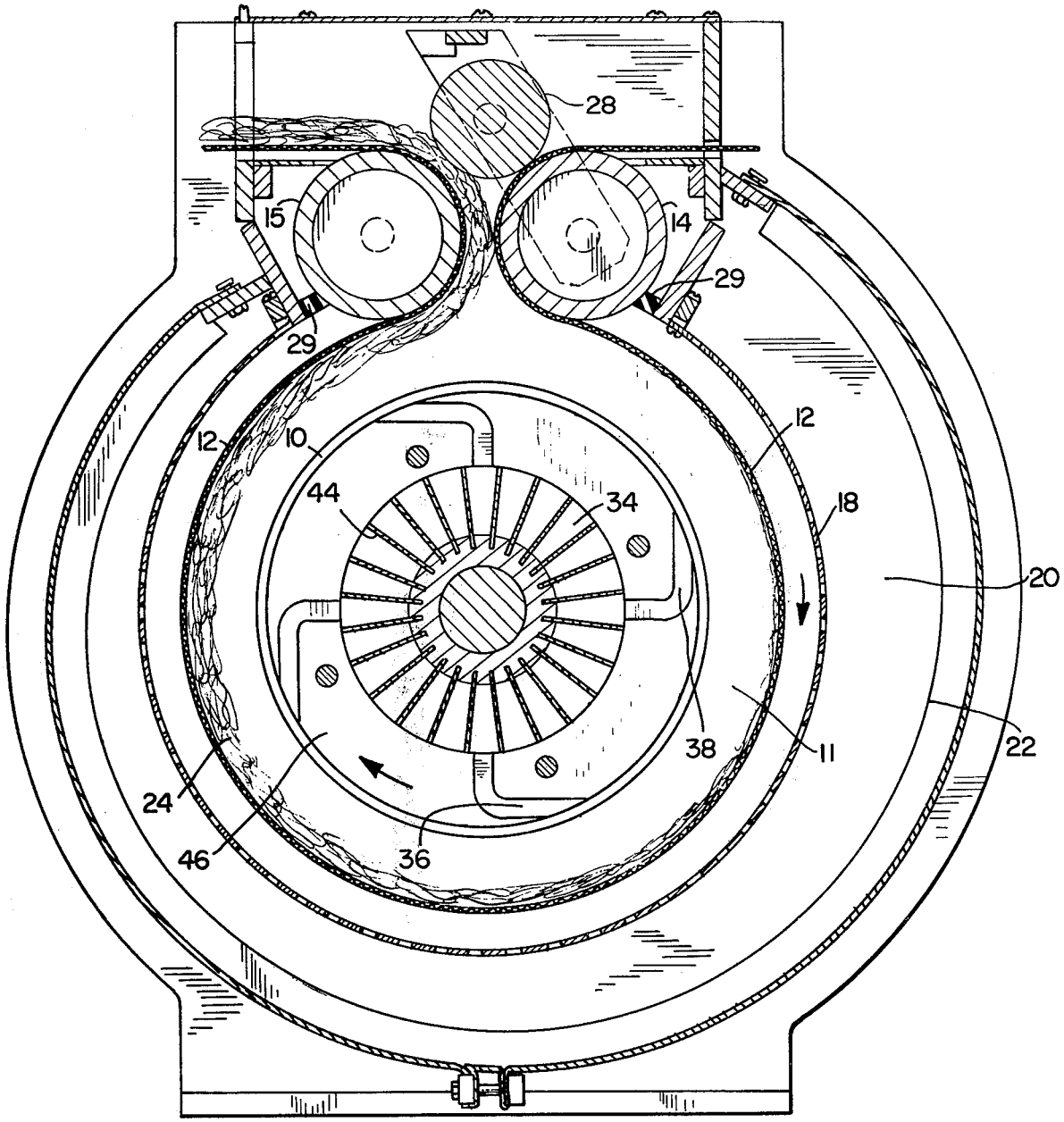
FIG. 4A is a cross-sectional view along the line 4—4 of FIG. 3 showing a similar but different embodiment.

It will be noted in FIG. 4 that the belt 12 moves in its arc path in a direction opposite to the direction of rotation of the spinner 10, in a preferred embodiment of the invention. In another embodiment the belt 12 moves in its arc path in the same direction as the direction of rotation of the spinner 10. This embodiment is illustrated in FIG. 4A which is identical with FIG. 4 except for the direction of rotation of the spinner 10 and the shape of the arcuate channels 38. These channels 38 in FIG. 4A are pointing in the opposite direction from those in FIG. 4 because the direction of rotation of the spinner 10 is reversed and the fiber laden air stream must be directed in a direction away from and opposite to the direction of rotation of the spinner.

Figure 5:
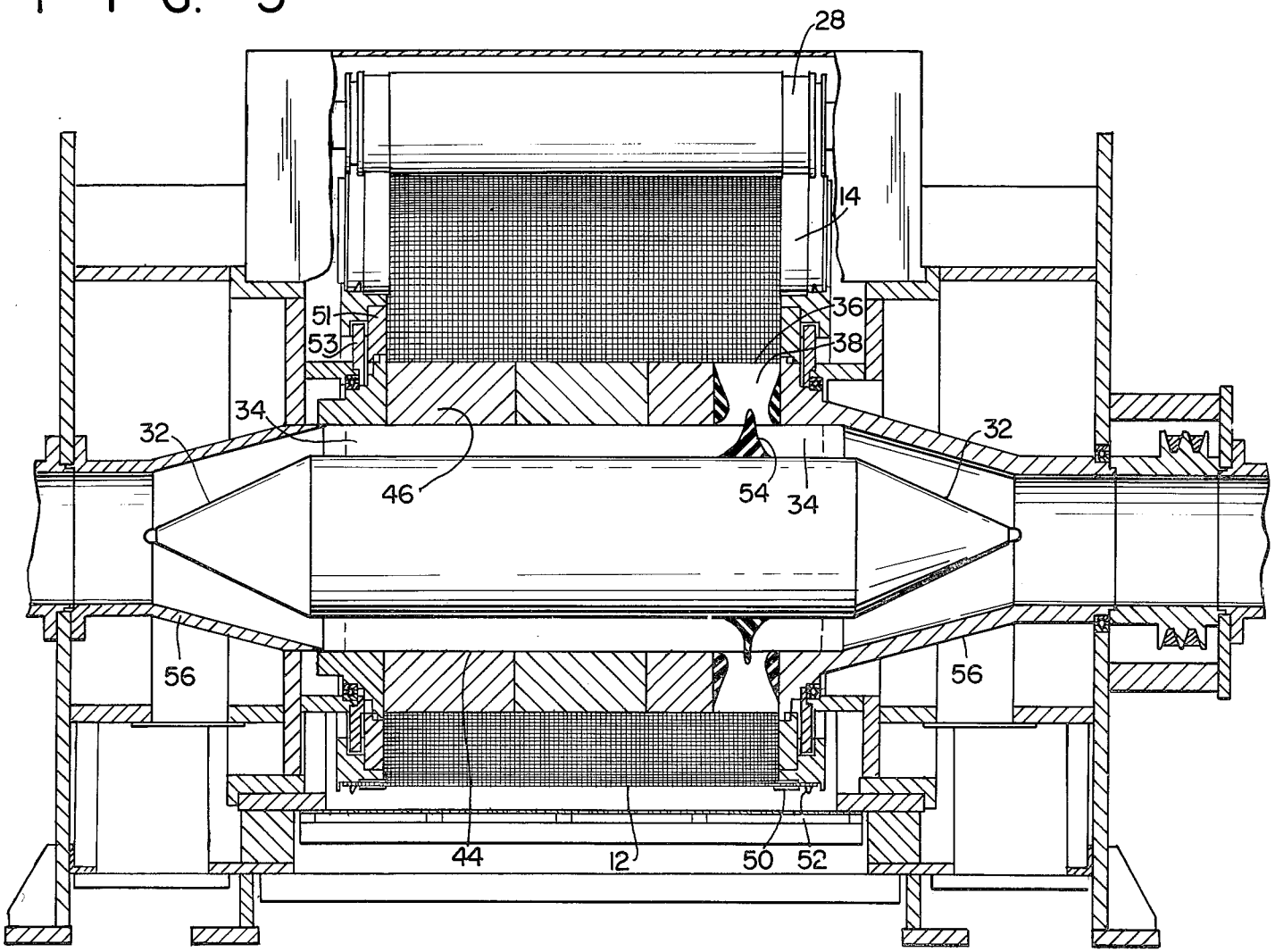
FIG. 5 is a cross-sectional view along the line 3/5 — 3/5 of FIG. 1 showing a double-ended spinner.

The double ended spinner 10*a* of FIG. 5 is quite similar to the single ended spinner 10 of FIG. 3 in many respects, however there are significant differences. The fiber laden air stream enters at both ends and is deflected into the conduits 34 by the two cones 32. Thus the fiber laden air stream or slurry enters each conduit 34 from opposite ends of the same conduit and a deflector 54 cause the fiber laden stream to enter arcuate channels 38 and flow in centrifugal flow through the openings 36. Because the spinner 10*a* is double ended there is no center shaft as in the single ended spinner 10 of FIG. 3, but the end-covers 56 from part of a rotating unit driven through drive belt 58.

Figure 6:
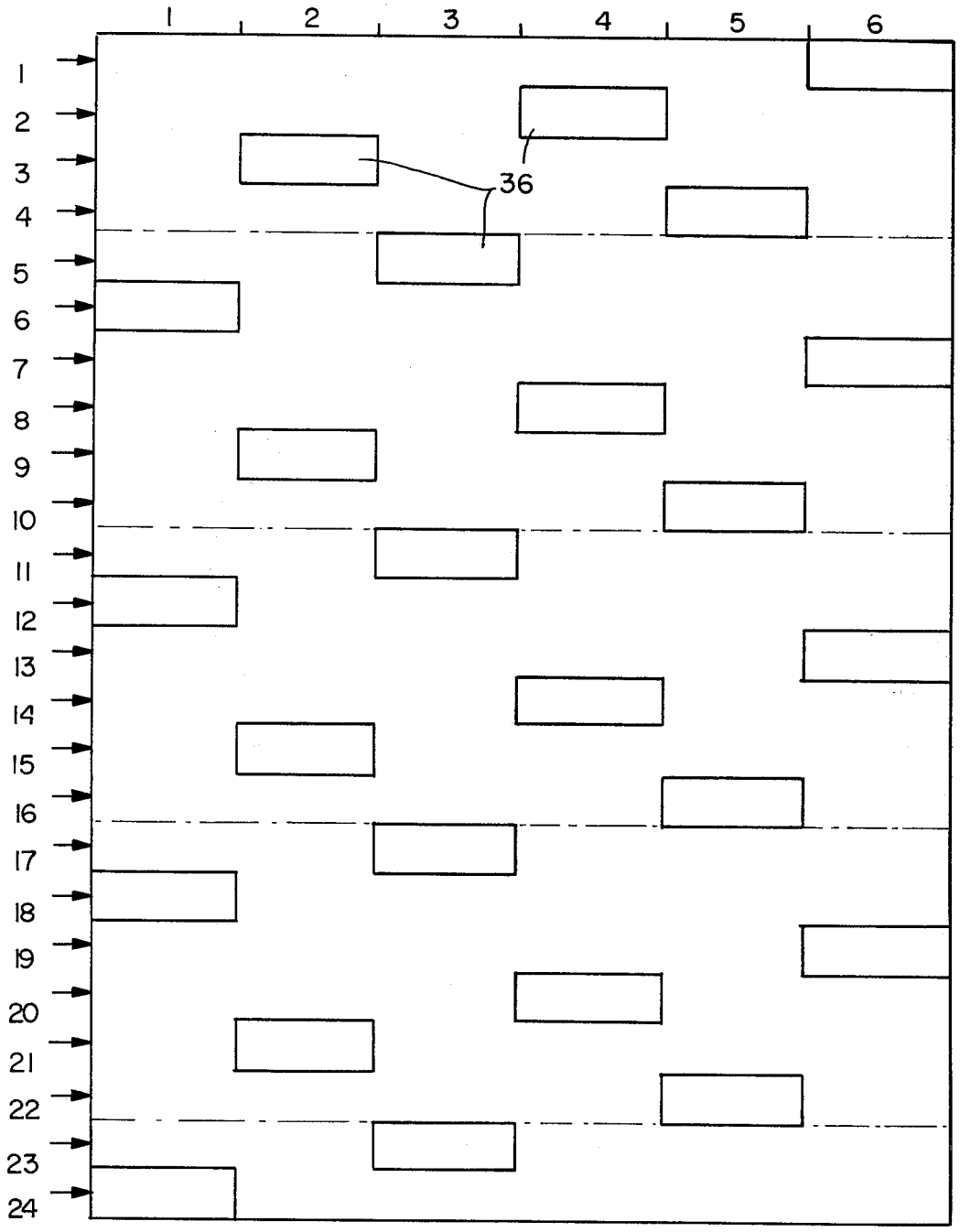
FIG. 6 is a diagrammatic view of a slot arrangement for a single-ended spinner.
Figure 7:
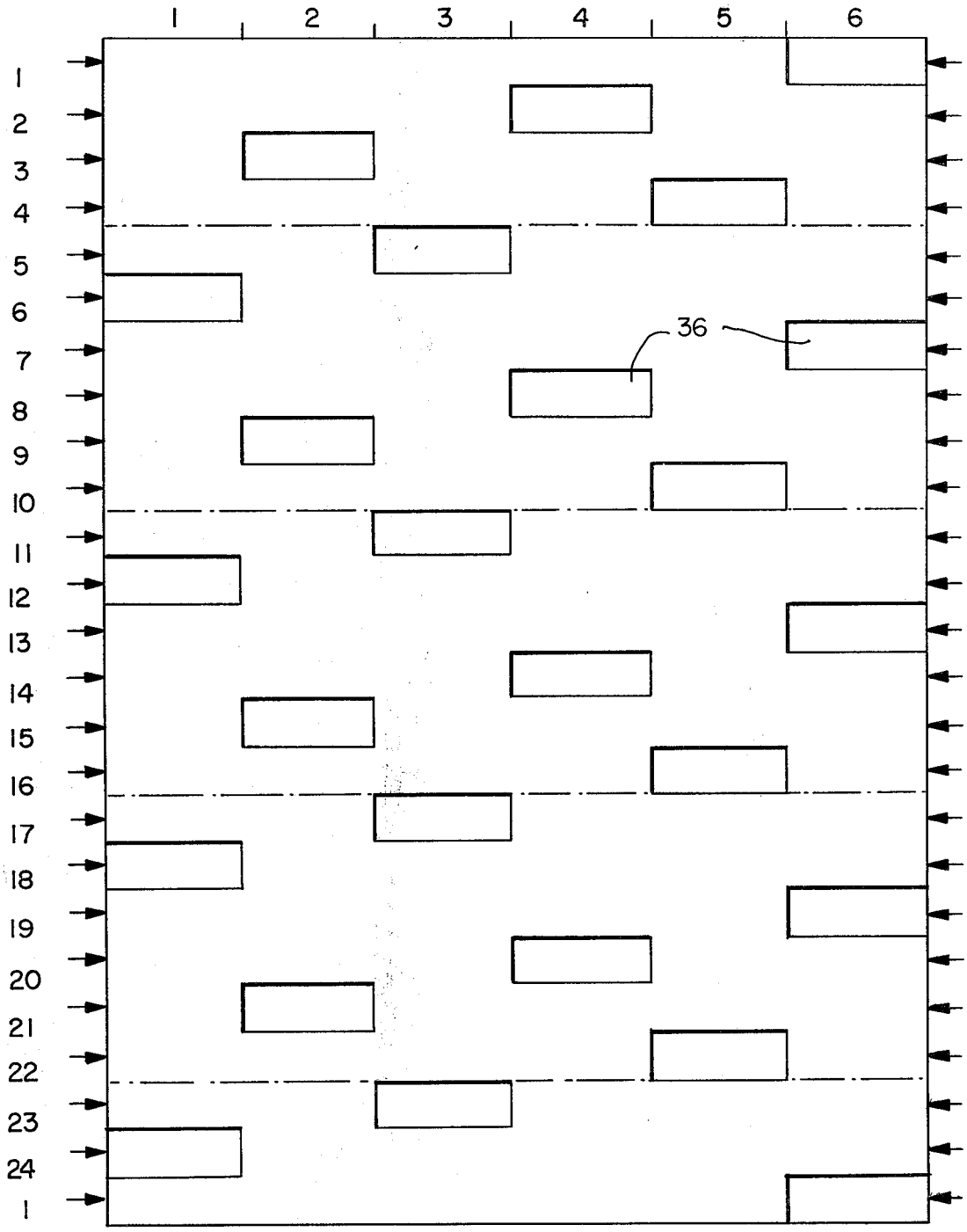
FIGS. 7 through 10 are diagrammatic view of different slot arrangement for a double-ended spinner.

FIG. 6 is a diagrammatic view of the outer surface of the rotating spinnner 10 of FIG. 3, the outer surface of the cylinder being shown in "unrolled" form in a two-dimensioned drawing to illustrate the staggered arrangement of the openings 36 through which the fiber laden air stream or slurry is expelled. In the illustrated embodiment there are a total of twenty-four openings 36 arranged in six axial zone along the axis of the spinner, with four openings in each zone. Each opening 36 is fed from only one side, as the arrows indicate, since it is a single-ended spinner. In FIG. 7 the same arrangement of openings 36 is shown but as the arrows on both sides indicate each of the openings 36 is fed from both ends as this is a double ended spinner 10*a* as in FIG. 5.

Figure 8:
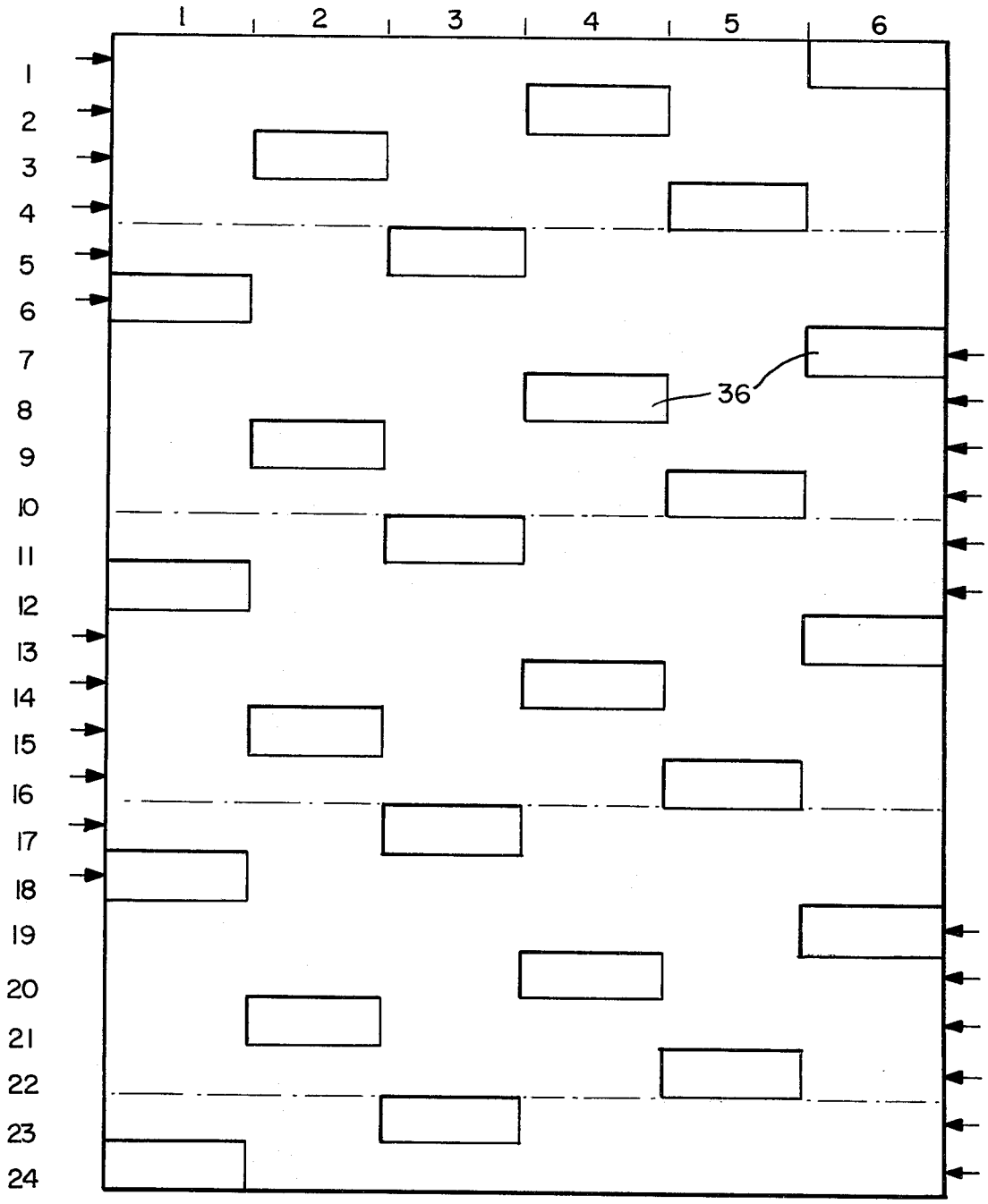

FIG. 8 shows a variation in the embodiment of FIG. 7. In this FIG. 8 the pattern of openings 36 is the sames as in FIGS. 6 and 7 however each opening 36 is fed from only one end of the double ended spinner 10*a*. The supply to openings in each axial zone alternates between ends to achieve balance however there is a reduction in mass flow rate compared to feeding each opening from both ends.

Figure 9:
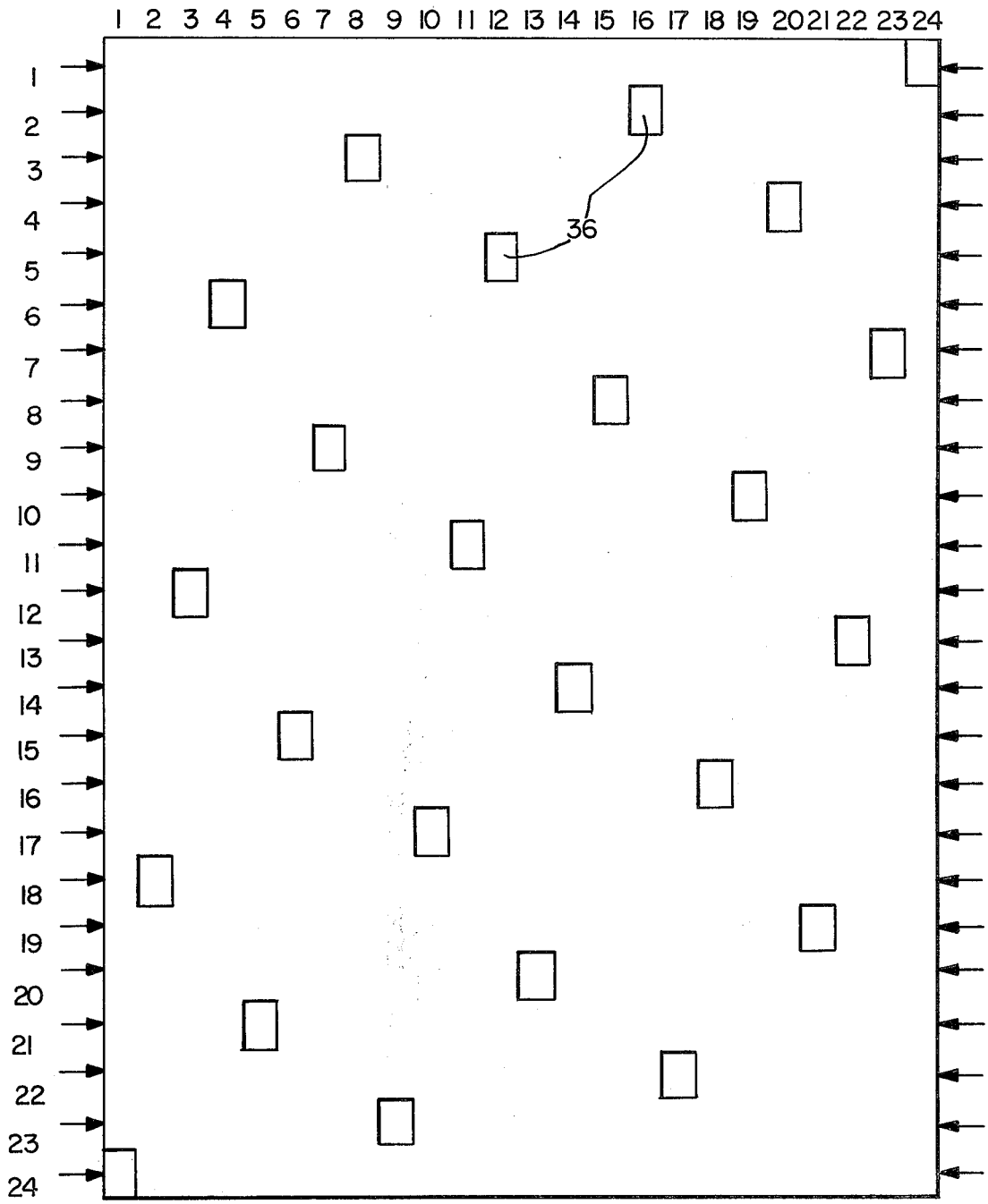
Figure 10:
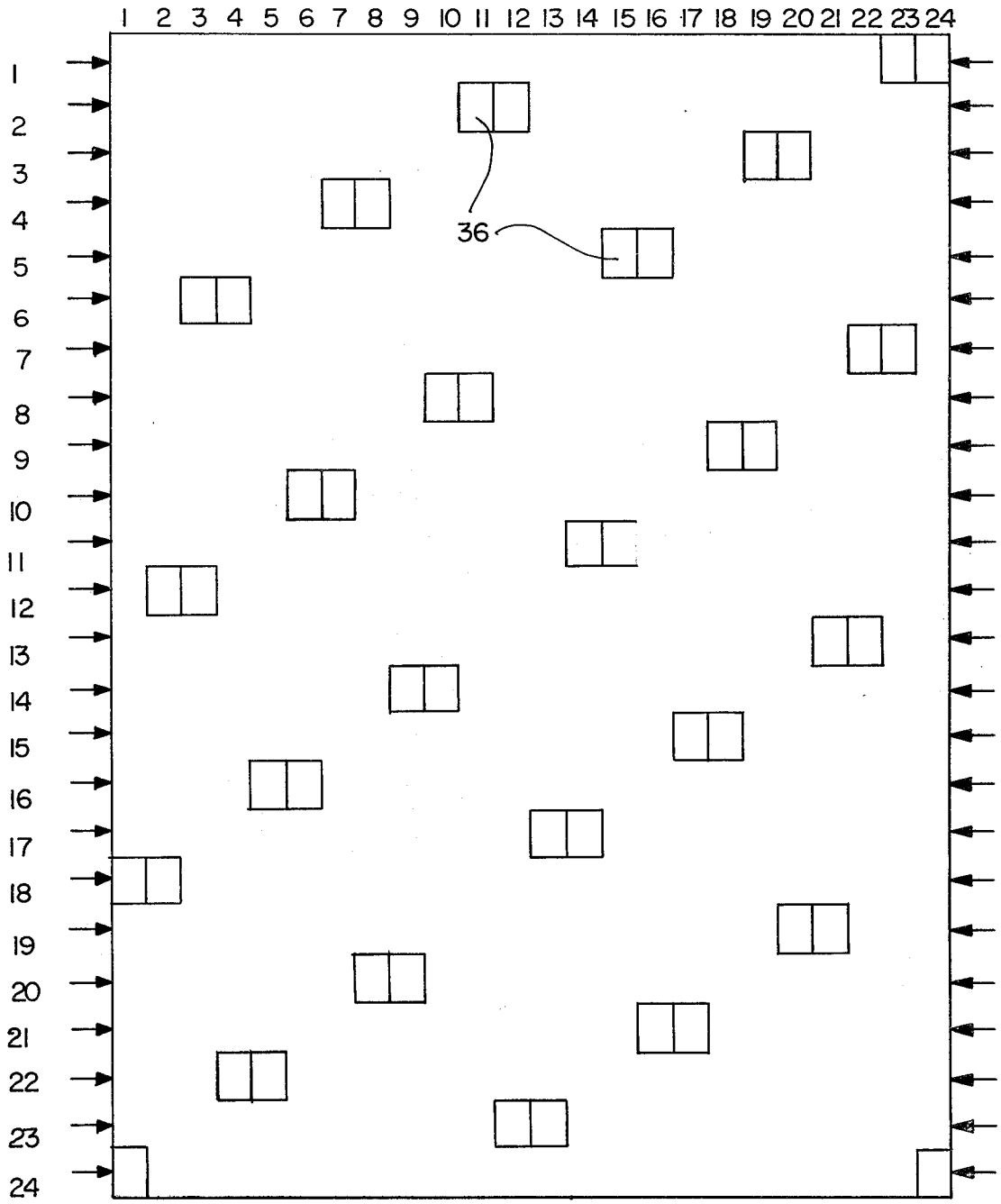

FIG. 9 is similar to FIG. 7 with the same number of openings 36, 24, each fed from both ends. The openings themselves are smaller, however, and each is in its own axial zone. FIG. 10 is a preferred pattern for a double ended spinner with paired openings fed from opposite sides and arranged to provide two openings in each axial zone. This arrangement averages the distance of fiber flow to each axial zone while preserving maximum flow rate.

Figure 11:
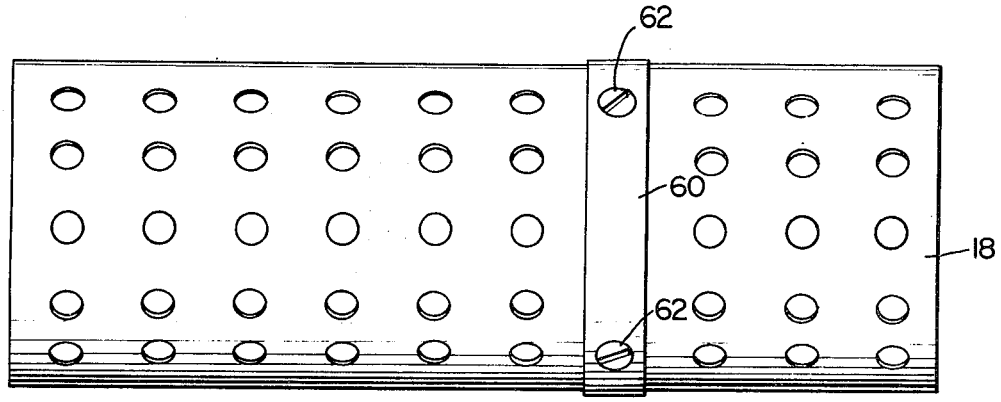
FIGS. 11 and 12 show two different ways of controlling the degree and pattern of suction applied.
Figure 12:
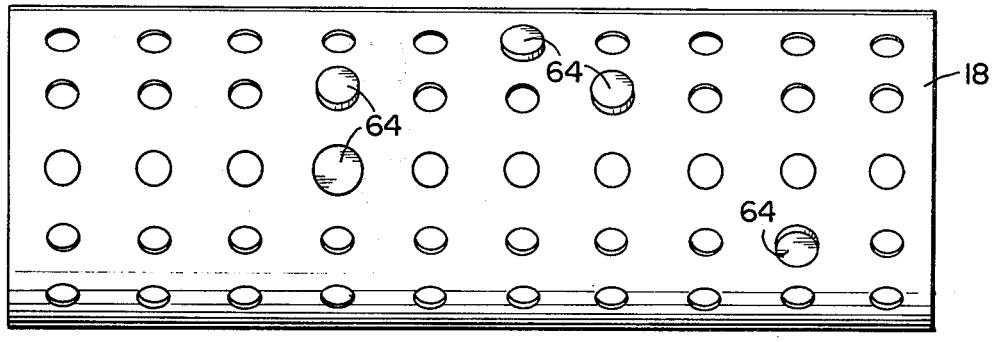
Figure 13:
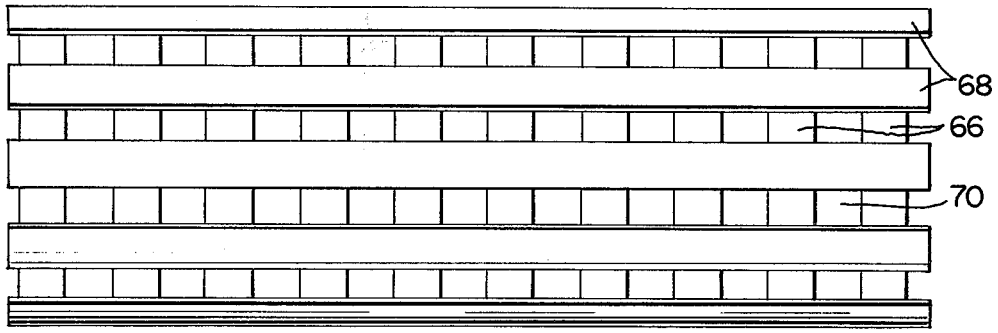
FIG. 13 shows an alternate construction for the perforate suction control plate.

The manner and degree in which suction is applied through the foraminous screen or belt 12 can be controlled by selectively blocking the holes in the perforate suction control plate 18 of FIGS. 1, 3, 4 and 5. This can be done as shown in FIG. 11 using moveable curved bands 60 attached by screws 62 to selectively cover the desired number and pattern of holes in the perforate suction control plate 18. In another embodiment shown in FIG. 12 removeable plugs 64 are inserted in the desired number and pattern of holes in the perforate suction control plate 18. In yet another embodiment as shown in FIG. 13 the suction control can be achieved by using as the perforate suction control plate a combination of moveable curved bars 66 encircling the spinner 10 and cooperating straight bars 68 aligned parallel with the axis of the spinner 10 moveably attached to the curved bars 66. The two sets of bars 66 and 68 cooperate to define perforate openingss 70 which can be controlled in size and number by varying the size and position of the bars 66 and 68.

The operation of the apparatus of the illustrated embodiment can be further considered for a better understanding of the invention.

A continuous stream 30 of suitably opened fibers suspended in a carrier fluid such as air is supplied to the conduits 34, and numerous types of fibers may be employed, such as wood, cotton, asbestos and staple fibers made from various man-made fibers, such as nylon, polyester, acrylics, modacrylics, rayon, synthetic cellulose, glass and the like. Mixtures of such fibers may also be employed. These fibers are opened to the point where each fiber is separated from the others. Long staple fibers can be fluffed up and separated by well-known devices such as cards, garnets and opening pickers. On the other hand, wood cellulose, usually provided in sheet form can be opened by disc grinders, hammer mills or the like. The design and relative size of the spinner may be varied to some extent according to the length and type of fibers used. The cone 32 serves to separate and distribute the incoming stream 30 evenly among the conduits 34. The stream 30 should not include more than 1 pound of fibers per 300 cubic feet of air. A suitable binder for the fibers such as a heat-receive powder or fibers such as polyvinyl chloride, low density polyethylene or the like may be added to stream 30 if desired.

The rotation of the plurality of conduits 34 and connected arcuate channels 38 and openings 36 results in multiple centrifugal flows of fiber laden air emerging at multiple points around the exterior surface of the spinner 10 into the deposit area 11. The rotating spinner 10 expel the fiber laden air through these multiple openings 36 so as to uniformly scan the surface of the moving foraminous screen or belt 12 and achieve a highly uniform deposit. In one embodiment of the invention the spinner 10 rotates in the opposite direction from the arc path of movement of the belt 12 so that the direction of rotation of the fiber-containing fluid stream is opposite to the direction of movement of the as-formed web around the path of the arc. The speed of rotation can be coordinated with the speed of the belt and the shape of the arcuate channels 38 and openings 36 so that the centrifugal flow of fiber laden air from the openings 36 is essentially radial. In another embodiment of the invention the spinner 10 rotates in the same direction as the arc path of movement of the belt 12 so that the direction of rotation of the fiber-containing fluid stream is the same as the direction of movement of the as-formed web around the path of said arc.

The multiplicity and spacing of the openings 36 around the outer surface of the spinner 10, as exemplified in FIGS. 6 through 10 of the drawing contributes to the uniformity of the fiber deposit. It should also be noted that the arcuate channels 38 direct the fiber laden stream back in a direction away from and opposite to the direction of rotation of the spinner 10. Thus the openings 36 are constantly rotating in a path of movement generally away from the point of instantaneous impingement of the fibers on the belt 12. This greatly reduces the actual velocity of the fibers when they leave the openings 36. At this reduced velocity the fibers are susceptible to the attraction of the suction generated by the reduced pressure resulting from the exhausting of air from the plenum 20. This suction applied through the perforate suction control plate 18 and through the foraminous screen or belt 12 draws the fibers to the belt 18 in a uniform web.

As the belt 12 moves in an arc around the axis of the centrifugal flow of fibers from the spinner 10 the fibrous mat or web builds up and increases in weight. And as the web 24 increases in weight the air resistance of the web 24 also increases. It is important however that the unit volume of air flow through the web and belt 12 be maintained constant around the arc of movement of the belt 12 around the spinner 10. This is accomplished by gradually decreasing the air resistance of the perforate suction control plate 18 as the resistance of the web 24 increases as it moves in its arc path around the spinner 10. Such reduction can be achieved changing plugs or moving bars in the embodiments of FIGS. 11, 12 and 13, as described above, or in the manner otherwise appropriate to the particular type of perforate suction control plate employed. Thus as the web 24 becomes heavier and more air resistant the resistance of the perforate suction control plate 18 is decreased to allow greater suction to be applied to the heavier web 24. The effect is to maintain the total combined air resistance of the web 24, belt 12 and plate 18 constant around the arc of movement, thus issuing a uniform unit volume of air flow from the deposit area 11 through the web 24, belt 12 and suction control plate 18 into the plenum 20.

The air pressure in the deposit area 11 from the incoming stream 30 and the suction in the plenum area 20 are adjusted so that there is a constant slight positive pressure in the deposit area 11. Preferably this pressure is from 0.02 to 0.05 pounds per square inch gauge.

The sealing roller 28 is adjusted according to the thickness of the web 24 being produced and the desired density thereof so that the roller 28 bears against the web 24 and maintains constant pressure in the deposit area 11. Air exhausted from the plenum 20 can be recirculated if desired. The fibrous mat or web 24 after passing the sealing roller 28 can be wound up on the take up roll 26 as shown. The fiber removal means 27 which can be used assist in removing the fibrous web 24 from the belt 12 may be on air knife or any other suitable take-off device. Alternately the web 24 can be passed to a processing station for any desired further treatment such as spraying with a binder or the like.

What is claimed is:

1. The method of making a non-woven fibrous web which comprises: providing a fluid stream, incorporating fibers into said stream, continuously rotating the fiber containing fluid stream to direct said stream in a centrifugal flow and directing said stream by arcuate channels of a rotor and causing said fibers to exit from said channels in a direction opposite to the direction of movement of the periphery of said rotor, whereby the velocity of said fibers is greatly reduced, collecting said fibers from said centrifugally flowing stream in a substantially endless web of uniform thickness contained in an arc around the axis of rotation of said centrifugal flow, continuously moving said web substantially in a circuit around said rotor, sealing across spaced portions of said web to assist in maintaining pressure in a region bounded by said web as it moves around said rotor by contacting said portions by means positioned therebetween and recovering said web after it leaves said region.

2. The method according to claim 1 wherein the direction of rotation of said fiber-containing fluid stream is opposite to the direction of movement of said as-formed web around the path of said arc.

3. The method according to claim 1 wherein the direction of rotation of said fiber-containing fluid stream is the same as the direction of movement of said as-formed web around the path of said arc.

4. The method according to claim 1 wherein said flow is a substantially radial flow.

5. The method according to claim 1 wherein said fibers are collected from said flow using suction.

6. The method according to claim 1 wherein said fibers are wood pulp fibers.

7. The method according to claim 1 wherein said fibers are staple fibers.

8. The method according to claim 1 wherein said fibers are a mixture of wood pulp fibers and staple fibers.

9. The method according to claim 1 wherein binder is added to said fluid stream prior to its being directed in said centrifugal flow.

10. The method according to claim 1 wherein binder is applied to said endless web after its formation.

11. The method according to claim 1 wherein said fluid stream is a gas stream.

12. The method according to claim 11 wherein said gas is air.

13. The method of making a non-woven fibrous web which comprises: providing a fluid stream, incorporating fibers into said stream, continuously rotating the fiber containing fluid stream to direct said stream in a centrifugal flow and directing said stream by arcuate channels of a rotor and causing said fibers to exit from said channels in a direction opposite to the direction of movement of the periphery of said rotor, whereby the velocity of said fibers is greatly reduced collecting said fibers from said centrifugally flowing stream in a substantially endless web of uniform thickness on a foraminous surface moving in a circumferential direction around said rotor while permitting said fluid to flow through said foraminous surface, continuously moving said web substantially in a circuit around said rotor, sealing across spaced portions of said web to assist in maintaining pressure in a region bounded by said web as it moves around said rotor by contacting said portions with means positioned therebetween and recovering said web from said foraminous surface after it leaves said region.

14. The method according to claim 13 wherein suction is employed to accelerate the flow of said fluid through said foraminous surface and the collection of fibers on said foraminous surface.

15. The method according to claim 14 wherein the intensity of the suction at particular points around said arc is controlled by a variable air flow resistance means behind said belt.

16. The method according to claim 15 wherein the unit volume of air flow through said web and foraminous belt is maintained constant for all areas around the arc of movement of said belt by decreasing the resistance of the variable air flow resistance means proportionately as the web builds up and developes greater resistance as the belt moves around said arc.

* * * * *

UNITED STATES PATENT OFFICE
CERTIFICATE OF CORRECTION

Patent No. 3,966,858 Issue Date June 29, 1976

Inventor(s) Marion F. Troy and Ewald A. Kamp

It is certified that error appears in the above-identified patent and that said Letters Patent are hereby corrected as shown below:

Column 4, line 26; "heat-receive" should read

--heat-reactive--

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*